US008540793B2

(12) United States Patent
Kasaoka et al.

(10) Patent No.: US 8,540,793 B2
(45) Date of Patent: Sep. 24, 2013

(54) EXHAUST PROCESSING DEVICE AND MANUFACTURING METHOD THEREOF

(75) Inventors: Yuuki Kasaoka, Hirakata (JP); Tatsushi Itou, Hirakata (JP); Shouhei Nagasaka, Oyama (JP); Hirofumi Takanuki, Oyama (JP)

(73) Assignee: Komatsu Ltd., Tokyo (JP)

( * ) Notice: Subject to any disclaimer, the term of this patent is extended or adjusted under 35 U.S.C. 154(b) by 465 days.

(21) Appl. No.: 12/990,674

(22) PCT Filed: May 8, 2009

(86) PCT No.: PCT/JP2009/058687

§ 371 (c)(1),
(2), (4) Date: Nov. 2, 2010

(87) PCT Pub. No.: WO2009/139333

PCT Pub. Date: Nov. 19, 2009

(65) Prior Publication Data

US 2011/0047963 A1 Mar. 3, 2011

(30) Foreign Application Priority Data

May 14, 2008 (JP) ..... 2008-127147

(51) Int. Cl.

| | |
|---|---|
| ***B01D 50/00*** | (2006.01) |
| ***B01D 39/14*** | (2006.01) |
| ***B01D 39/06*** | (2006.01) |
| ***B01D 24/00*** | (2006.01) |
| ***F01N 3/02*** | (2006.01) |
| ***F01N 5/02*** | (2006.01) |
| ***F01D 3/04*** | (2006.01) |
| ***F01D 1/00*** | (2006.01) |
| ***F01D 3/00*** | (2006.01) |

(52) U.S. Cl.
USPC ..... 55/523; 55/522; 55/524; 422/169; 422/170; 422/172; 422/171; 422/177; 422/178; 422/179; 422/180; 422/181; 422/182; 60/309; 60/272; 60/298; 60/310; 60/320; 60/324

(58) Field of Classification Search
USPC ..... 55/522–524; 422/169–172, 177–182; 60/309, 272, 298, 310, 320, 324, 289
See application file for complete search history.

(56) References Cited

U.S. PATENT DOCUMENTS 3,796,546 A * 3/1974 Poullot ..... 422/171
4,039,293 A * 8/1977 Tanahashi et al. ..... 422/177

(Continued)

FOREIGN PATENT DOCUMENTS

CN 2162799 Y 4/1994
CN 2469382 Y 1/2002

(Continued)

OTHER PUBLICATIONS

International Search Report of corresponding PCT Application No. PCT/JP2009/058687, Dated: Aug. 2009.

*Primary Examiner* — Amber Orlando
(74) *Attorney, Agent, or Firm* — Global IP Counselors, LLP

(57) ABSTRACT

An exhaust processing device includes a main body tube portion and a closing tube portion. The main body tube portion includes an opening in an axial end thereof, houses a main body exhaust path in an inside thereof, which allows an exhaust gas to pass therethrough. The closing tube portion includes a plate portion and a tubular portion. The plate portion covers the opening of the axial end of the main body tube portion. The tubular portion radially outwardly protrudes from an outer peripheral surface of the main body tube portion, and is integrated with the plate portion. The tubular portion houses an exhaust path in an inside thereof, which communicates with the main body exhaust path. The tubular portion of the closing tube portion includes a first split half portion integrally molded with the plate portion, and a second split half portion joined to the first split half portion.

6 Claims, 9 Drawing Sheets

(56) References Cited

U.S. PATENT DOCUMENTS

| | | | | | |
|---|---|---|---|---|---|
| 4,125,380 | A | * | 11/1978 | Negola | 422/180 |
| 4,239,733 | A | * | 12/1980 | Foster et al. | 422/179 |
| 4,328,188 | A | * | 5/1982 | Kawata | 422/180 |
| 5,207,989 | A | * | 5/1993 | MacNeil | 422/179 |
| 5,250,269 | A | * | 10/1993 | Langer | 422/179 |
| 5,329,698 | A | * | 7/1994 | Abbott | 29/890 |
| 5,385,873 | A | * | 1/1995 | MacNeill | 501/95.1 |
| 5,419,876 | A | * | 5/1995 | Usui et al. | 422/177 |
| 5,482,681 | A | * | 1/1996 | Sager, Jr. | 422/180 |
| 6,162,403 | A | * | 12/2000 | Foster et al. | 422/173 |
| 6,247,304 | B1 | * | 6/2001 | Kim et al. | 60/299 |
| 6,325,834 | B1 | * | 12/2001 | Fonseca et al. | 55/385.3 |
| 7,155,902 | B2 | * | 1/2007 | Nakagome | 60/299 |
| 7,572,416 | B2 | * | 8/2009 | Alward et al. | 422/180 |
| 7,713,493 | B2 | * | 5/2010 | Bosanec et al. | 422/180 |
| 2004/0141889 | A1 | * | 7/2004 | Li et al. | 422/180 |
| 2009/0260351 | A1 | * | 10/2009 | Cremeens et al. | 60/310 |
| 2010/0209309 | A1 | * | 8/2010 | Masuda | 422/180 |
| 2011/0120085 | A1 | * | 5/2011 | Saito et al. | 60/272 |

FOREIGN PATENT DOCUMENTS

| | | | |
|---|---|---|---|
| CN | 2903469 | Y | 5/2007 |
| CN | 201154799 | Y | 11/2008 |
| JP | 2-221625 | A | 9/1990 |
| JP | 6-60726 | U | 8/1994 |
| JP | 11-280471 | A | 10/1999 |
| JP | 2003-90214 | A | 3/2003 |
| JP | 2007-16636 | A | 1/2007 |

* cited by examiner

EXHAUST PROCESSING DEVICE AND MANUFACTURING METHOD THEREOF

CROSS-REFERENCE TO RELATED APPLICATIONS

This national phase application claims priority to Japanese Patent Application No. 2008-127147 filed on May 14, 2008. The entire disclosure of Japanese Patent Application No. 2008-127147 is hereby incorporated herein by reference.

TECHNICAL FIELD

The present invention relates to an exhaust processing device and a manufacturing method thereof.

BACKGROUND ART

The well-known types of the internal combustion engine have an exhaust processing device in an exhaust path. The exhaust processing device is configured to capture particulate materials in an exhaust gas exhausted from the internal combustion engine (e.g., the diesel engine) or reduce a volume of $NO_x$ in the exhaust gas. An exemplary exhaust processing device is described in Japan Laid-Open Patent Application Publication No. JP-A-2003-090214. The exhaust processing device includes an inlet tube, an outlet tube, and a main body tube portion. The inlet tube and the outlet tube are disposed on the both ends of the main body tube portion. The inlet and outlet tubes are radial-outwardly protruded from the outer peripheral surface of the main body tube portion. Further, the inlet tube and the outlet tube are inserted into the main body tube portion. Exhaust gas enters the main body tube portion from the internal combustion engine through the inlet tube. Then, the exhaust gas is discharged from the main body tube portion through the outlet tube. The main body tube portion contains a carrier in the inside thereof. The carrier supports a catalyst. The carrier purifies the exhaust gas passing therethrough.

SUMMARY

The aforementioned exhaust processing device is manufactured by joining plural components, including the inlet tube, the outlet tube, and the main body tube portion, in combination. In view of increase in yield rate and reduction in manufacturing cost, however, an easily manufacturable exhaust processing device has been demanded.

The present invention addresses a need for producing an easily manufacturable exhaust processing device and a manufacturing method thereof.

An exhaust processing device according to a first aspect of the present invention includes a main body tube portion and a closing tube portion. The main body tube portion includes an opening in an axial end thereof. The main body tube portion houses a main body exhaust path in an inside thereof. The main body exhaust path allows an exhaust gas to pass therethrough. The closing tube portion includes a plate portion and a tubular portion. The plate portion covers the opening of the axial end of the main body tube portion. The tubular portion radially outwardly protrudes from an outer peripheral surface of the main body tube portion. The tubular portion is integrated with the plate portion. The tubular portion houses an exhaust path in an inside thereof The exhaust path communicates with the main body exhaust path.

According to the exhaust processing device of the first aspect of the present invention, the closing tube portion includes a plate portion, and the plate portion covers the opening of the axial end of the main body tube portion. Therefore, the closing tube portion is appropriately positioned with respect to the main body tube portion when the plate portion is attached to the main body tube portion under a condition that the plate portion closes the opening of the axial end of the main body tube portion. Further, the closing tube portion and the main body tube portion can be easily welded by executing welding along the opening of the axial end of the main body tube portion. Accordingly, the exhaust processing device can be easily manufactured.

An exhaust processing device according to a second aspect of the present invention relates to the exhaust processing device according to the first aspect of the present invention. In the exhaust processing device, the tubular portion includes a first split half portion and a second split half portion. The first split half portion is integrally molded with the plate portion, whereas the second split half portion is joined to the first split half portion. The first and second split half portions include convex and concave portions on joint surfaces thereof. The convex portion and the concave portion are configured to be engaged for appropriately positioning the first and second split half portions.

According to the exhaust processing device of the second aspect of the present invention, the first split half portion is appropriately positioned with respect to the main body tube portion by attaching the plate portion to the main body tube portion under a condition that the plate portion closes the opening of the axial end of the main body tube portion. Further, the second split half portion is appropriately positioned with respect to the first split half portion by attaching the first split half portion and the second split half portion under the condition that the convex portion and the concave portion are engaged. Accordingly, the closing tube portion and the main body tube portion can be easily assembled.

An exhaust processing device according to a third aspect of the present invention relates to the exhaust processing device according to the second aspect of the present invention. In the exhaust processing device, the first split half portion includes a flange portion disposed along an edge thereof and the second split half portion includes a flange portion disposed along an edge thereof. Further, the exhaust processing device further includes an annular member. The annular member is configured to be fitted onto the tubular portion with the annular member abutting ends of the flange portions for integrating the first split half portion and the second split half portion.

According to the exhaust processing device of the third aspect of the present invention, the first split half portion and the second split half portion are integrated by the annular member. Further, the annular member is appropriately positioned by the ends of the flange portions of the first split half portion and the second split half portion. Therefore, the closing tube portion can be easily assembled.

An exhaust processing device according to a fourth aspect of the present invention relates to the exhaust processing device according to the first aspect of the present invention. In the exhaust processing device, the main body tube portion includes a plurality of protrusions on an inner peripheral surface thereof. The protrusions are radially inwardly protruding from the inner peripheral surface of the main body tube portion. The protrusions are circumferentially aligned on the inner peripheral surface of the main body tube portion. The exhaust processing device further includes a meshed flow regulation member. The flow regulation member is joined to the inner peripheral surface of the main body tube portion with the flow regulation member being hooked on the protrusions.

According to the exhaust processing device of the fourth aspect of the present invention, the main body tube portion is disposed on the plate portion, and the flow regulation member is further disposed from above into the main body tube portion in assembling the exhaust processing device. The flow regulation member is thereby appropriately positioned under a condition that the flow regulation member is engaged with the protrusions. Therefore, the exhaust processing device can be easily assembled.

An exhaust processing device according to a fifth aspect of the present invention relates to the exhaust processing device according to the first aspect of the present invention. In the exhaust processing device, the plate portion includes a stepped portion dented to be matched with an edge of the axial end of the main body tube portion. Further, the axial end of the main body tube portion is appropriately positioned by the stepped portion abutted thereto.

According to the exhaust processing device according to the fifth aspect of the present invention, the plate portion can be appropriately positioned with respect to the end of the main body tube portion under a condition that the end of the main body tube portion is abutted to the stepped portion of the plate portion. Accordingly, the closing tube portion and the main body tube portion can be further easily assembled.

An exhaust processing device according to a sixth aspect of the present invention relates to the exhaust processing device according to the first aspect of the present invention. In the exhaust processing device, the main body tube portion includes an inner tube portion, a heat insulator, and an outer tube portion. The inner tube portion is joined to the plate portion. The heat insulator covers the outer peripheral surface of the inner tube portion. The outer tube portion covers an outer periphery of the heat insulator. The outer tube portion is axially longer than the inner tube portion.

According to the exhaust processing device of the sixth aspect of the present invention, the inner tube portion and the plate portion are joined in assembling the closing tube portion and the main body tube portion. The heat insulator is then attached to the outer peripheral surface of the inner tube portion. Subsequently, the outer tube portion is attached onto the inner tube portion that the heat insulator is attached thereto. Therefore, the inner tube portion and the closing tube portion, of relatively small sizes, can be assembled first. In other words, the closing tube portion and the main body tube portion can be easily assembled.

An exhaust processing device according to a seventh aspect of the present invention relates to the exhaust processing device according to the first aspect of the present invention. In the exhaust processing device, the tubular portion has a diameter that becomes larger towards the main body tube portion.

According to the exhaust processing device of the seventh aspect of the present invention, airflow resistance of exhaust gas can be reduced in the closing tube portion. Therefore, smooth flow of exhaust gas is achieved from the closing tube portion to the main body tube portion.

A method of manufacturing an exhaust processing device according to an eighth aspect of the present invention is a method of manufacturing an exhaust processing device including a main body tube portion and a tubular portion. The method includes the steps of assembling a closing tube portion and attaching the closing tube portion to a main body tube portion. The main body tube portion having an opening in an axial end thereof. The main body tube portion houses a main body exhaust path in an inside thereof. The main body exhaust path allows an exhaust gas to pass therethrough. The tubular portion radially inwardly protrudes from an outer peripheral surface of the main body tube portion. The tubular portion houses an exhaust path in an inside thereof. The exhaust path communicates with the main body exhaust path. In the step of assembling the closing tube portion, a second split half portion is attached to a first component. The first component includes a plate portion and a first split half portion integrally molded with the plate portion. The first split half portion and the second split half portion form the tubular portion. Then, the closing tube portion is attached to the main body tube portion to cover the opening of the axial end of the main body tube portion.

According to the method of manufacturing an exhaust processing device, the closing tube portion includes the plate portion. The closing tube portion is appropriately positioned with respect to the main body tube portion by attaching the plate portion to the main body tube portion under a condition that the plate portion closes the opening of the axial end of the main body tube portion. Further, the closing tube portion and the main body tube portion can be easily welded by executing welding along the opening formed in the axial end of the main body tube portion. Therefore, the exhaust processing device can be easily manufactured by the method of manufacturing an exhaust processing device.

Overall, according to the exhaust processing device of the present invention, the closing tube portion includes the plate portion, and the plate portion is configured to close the opening formed in the axial end of the main body tube portion. Therefore, the closing tube portion is appropriately positioned with respect to the main body tube portion by attaching the plate portion to the main body tube portion under a condition that the plate portion closes the opening formed in the axial end of the main body tube portion. Further, the closing tube portion and the main body tube portion can be easily welded by executing welding along the opening formed in the axial end of the main body tube portion. Accordingly, the exhaust processing device can be easily manufactured.

DESCRIPTION OF EMBODIMENTS

Structure of Exhaust Processing Device

Figure 1:
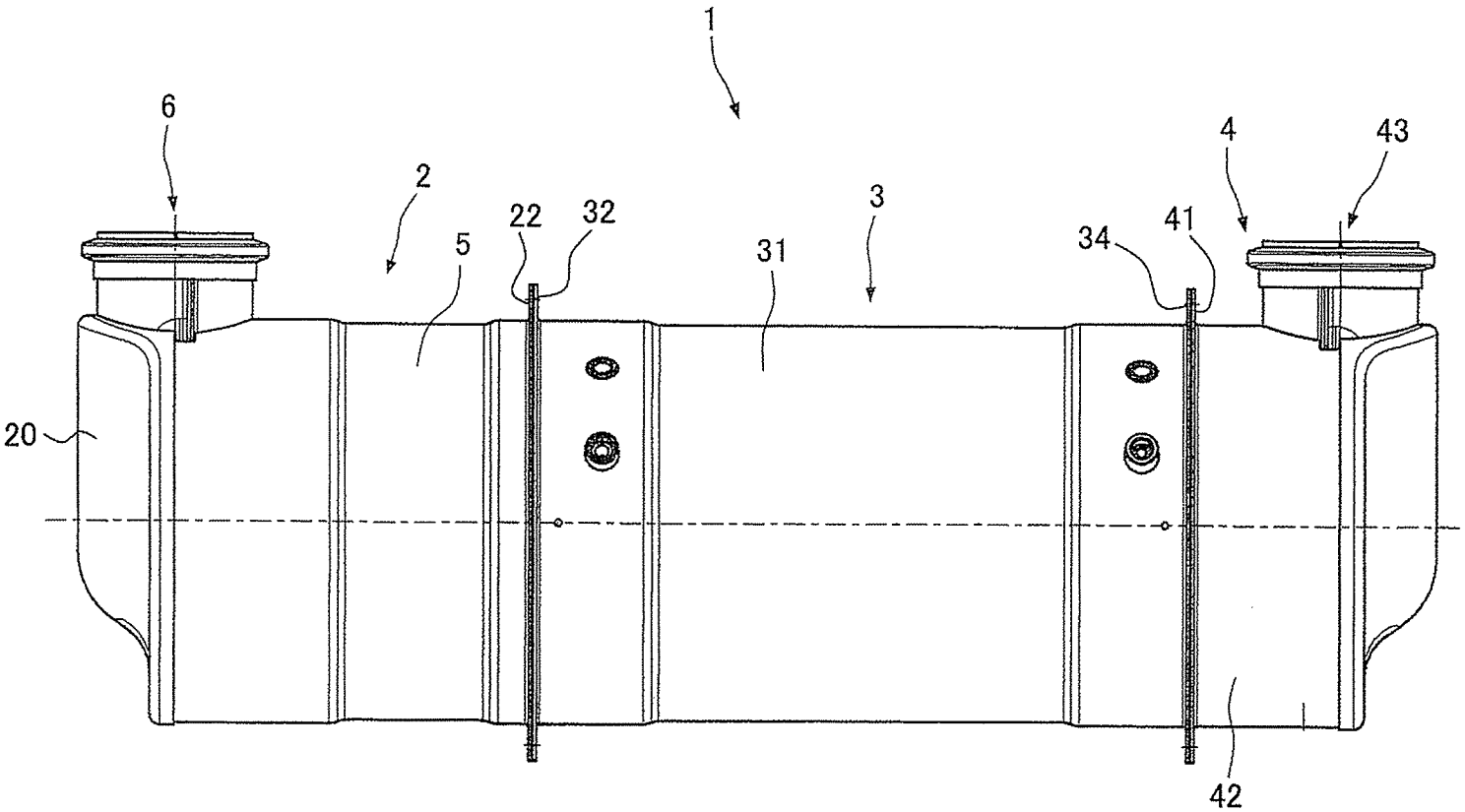
FIG. 1 is a side view of an exhaust processing device.
Figure 2:
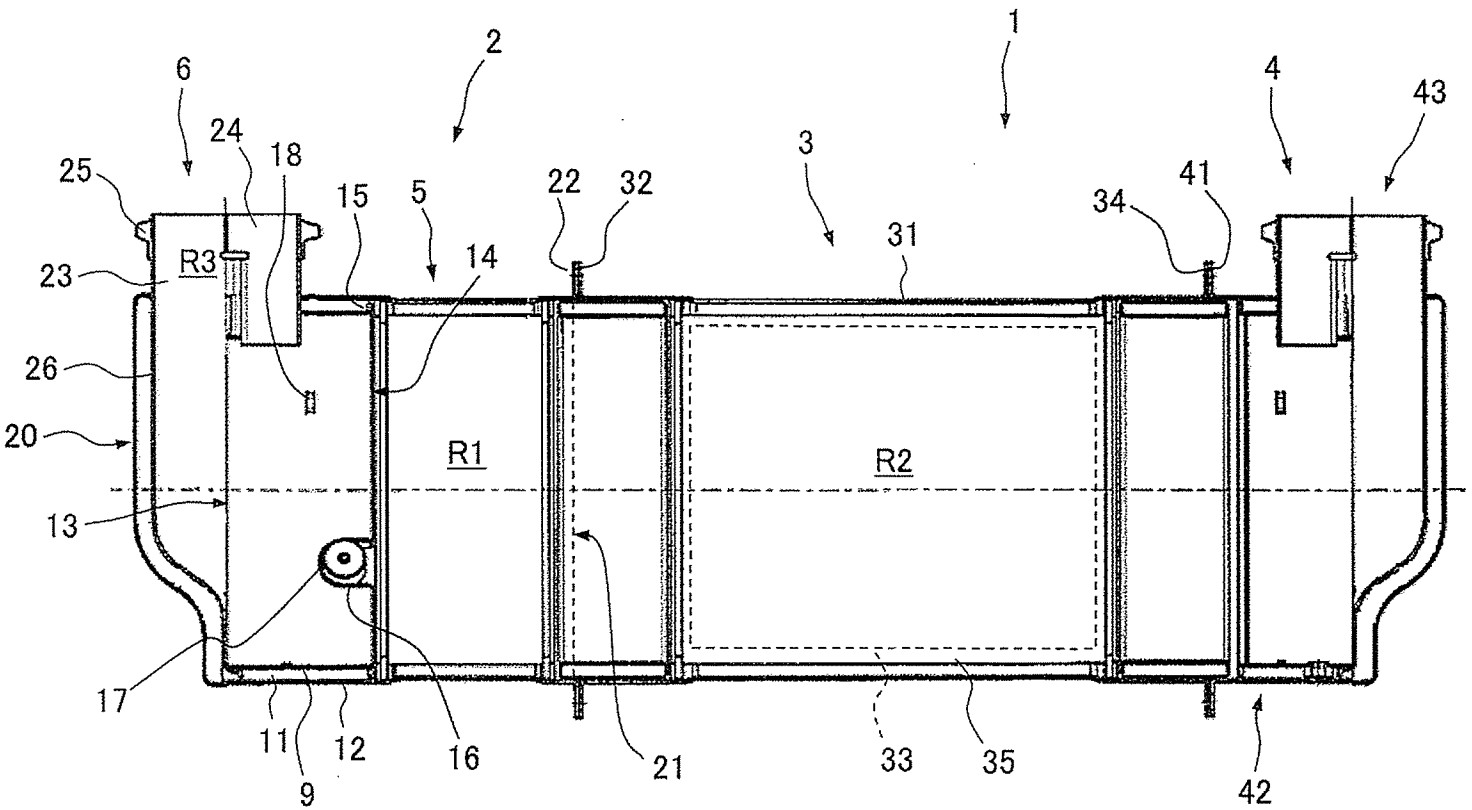
FIG. 2 is a cross-sectional side view of the exhaust processing device.

FIGS. 1 and 2 illustrate an exhaust processing device 1 according to an exemplary embodiment of the present invention. FIG. 1 is a side view of the exhaust processing device 1, whereas FIG. 2 is a cross-sectional side view of the exhaust processing device 1. The exhaust processing device 1 is a diesel particulate filter device configured to purify exhaust gas exhausted from the internal combustion engine (e.g., the diesel engine). The exhaust processing device 1 includes an inlet unit 2, a processing unit 3, and an outlet unit 4.

Inlet Unit 2

The inlet unit 2 is disposed upstream of the processing unit 3 in an exhaust gas flow. The inlet unit 2 is connected to an exhaust path (not illustrated in the figure) of the internal combustion engine. The inlet unit 2 includes a first main body tube portion 5 and an inlet tube portion 6 (closing tube portion).

The first main body tube portion 5 is a tubular member configured to be joined to the second main body tube portion 31. The first main body tube portion 5 is disposed coaxial to a second main body tube portion 31 (described below) of the processing unit 3. As illustrated in FIG. 2, the first main body tube portion 5 houses a main body exhaust path R1 in the inside thereof. The main body exhaust path R1 allows the exhaust gas to pass through. Further, the first main body tube portion 5 has axial ends opened. One of the axial ends of the first main body tube portion 5 is closed by a plate portion 26 (described below), whereas the other of the axial ends of the first main body tube portion 5 communicates with an exhaust path R2 disposed within the processing unit 3. The first main body tube portion 5 includes an inner tube portion 9, a flow regulation member 10 (see FIG. 9), a heat insulator 11, and an outer tube portion 12.

Figure 8:
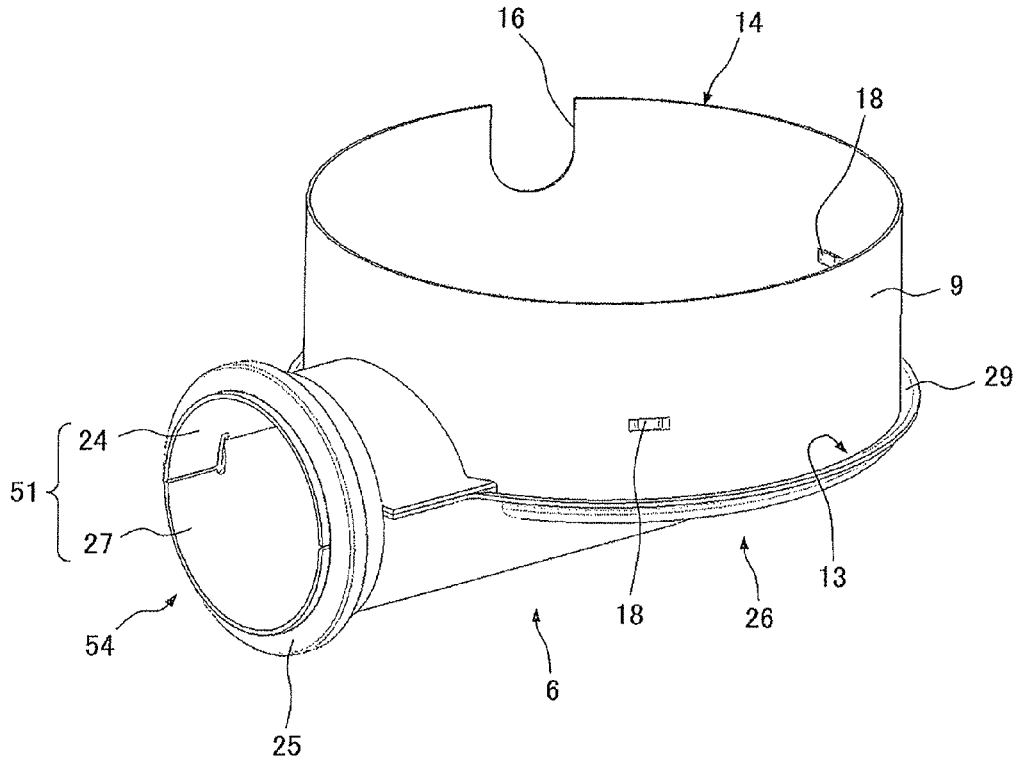
FIG. 8 is an oblique view of the inlet tube portion that an inner tube portion is attached thereto.
Figure 11:
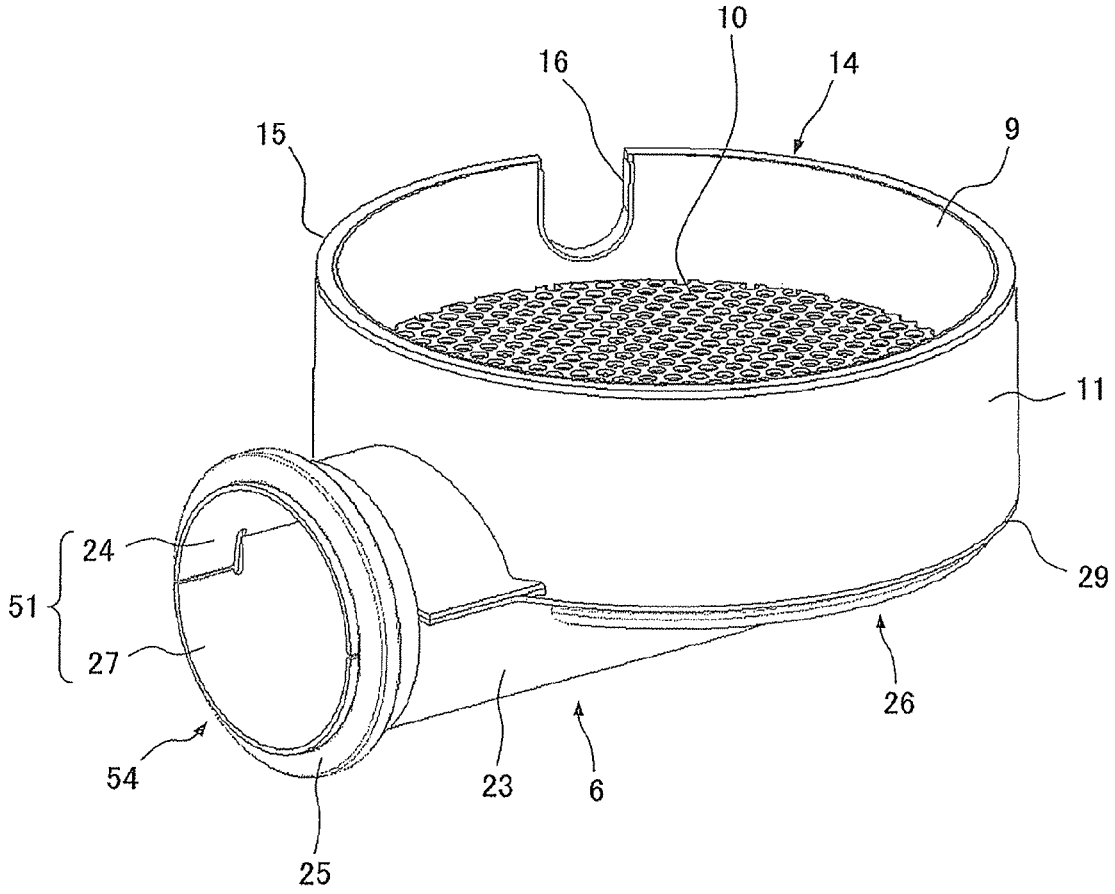
FIG. 11 is an oblique view of the inner tube portion that a heat insulator is wrapped therearound.
Figure 12:
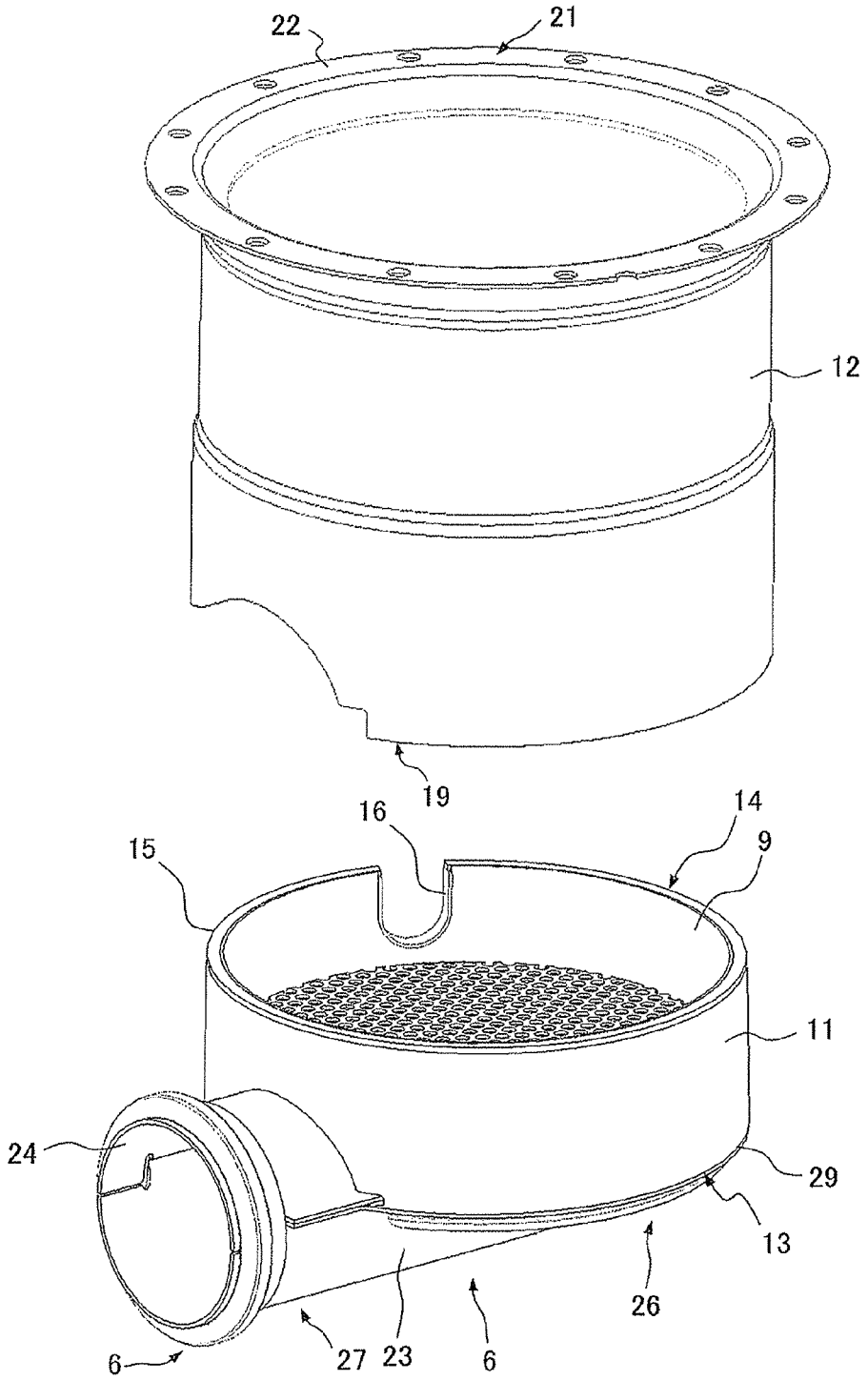
FIG. 12 is an oblique view of the inner tube portion and an outer tube portion, both of which are separated from each other.

As illustrated in FIGS. 2 and 12, the inner tube portion 9 is a tubular member disposed as the inner peripheral surface of the first main body tube portion 5. One of the axial ends of the inner tube portion 9 (hereinafter referred to as "a first inner end 13") is opened. The opening is closed when the first inner end 13 is joined to the plate portion 26. As illustrated in FIGS. 2 and 11, a ring member 15 is attached to the other of the axial ends of the inner tube portion 9 (hereinafter referred to as "a second inner end 14"). The ring member 15 prevents detachment of the heat insulator 11. Further, the second inner end 14 includes a cutout 16 recessed towards the first inner end 13. The cutout 16 is formed for avoiding contact between the second inner end 14 and a boss 17 (see FIG. 2) disposed on the inner peripheral surface of the outer tube portion 12. As illustrated in FIGS. 2 and 8, plural protrusions 18 are disposed on the inner peripheral surface of the inner tube portion 9. The protrusions 18 are circumferentially aligned on the inner peripheral surface of the inner tube portion while being radial inwardly protruded.

Figure 10:
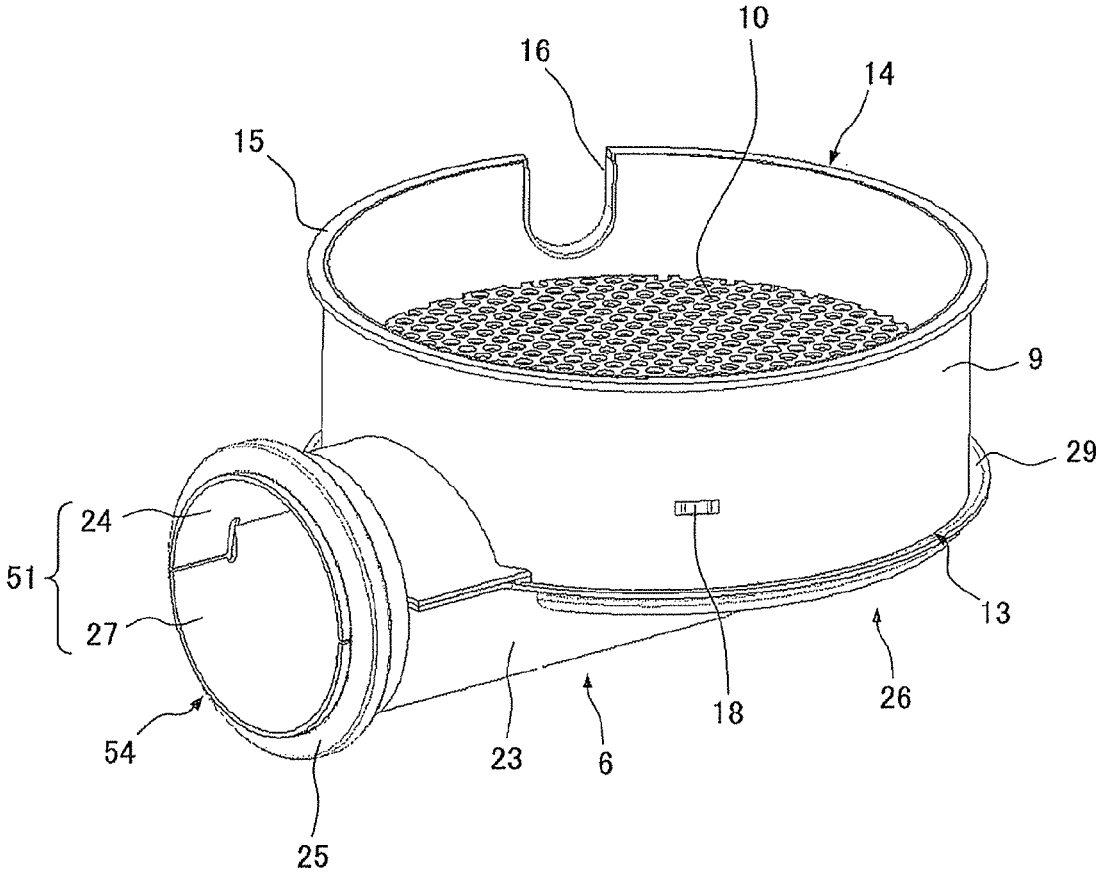
FIG. 10 is an oblique view of the inner tube portion that a ring member is attached thereto.

The flow regulation member 10 is configured to regulate a flow of exhaust gas transferred into the inlet unit 2. As illustrated in FIGS. 2 and 10, the flow regulation member 10 is formed in a meshed pattern. The flow regulation member 10 is joined to the inner peripheral surface of the main body tube portion while being hooked by the protrusions 18.

The heat insulator 11 is a mat member having a heat insulation property. As illustrated in FIGS. 2 and 12, the heat insulator 11 is disposed for covering the outer peripheral surface of the inner tube portion 9. The heat insulator 11 is axially retained by the ring member 15 attached to the inner tube portion 9 and a flange portion 29 (described below) of the plate portion 26.

The outer tube portion 12 is a tubular member axially longer than the inner tube portion 9. As illustrated in FIGS. 2 and 12, the outer tube portion 12 covers the inner tube portion 9 that the heat insulator 11 is wrapped therearound. In other words, the outer tube portion 12 is attached to the heat insulator 11 while covering the outer periphery of the heat insulator 11. As illustrated in FIG. 12, one of the axial ends of the outer tube portion 12 (hereinafter referred to as "a first outer end 19") is joined to the flange portion 29 of the plate portion 26. Further, the other end of the axial ends of the outer tube portion 12 (hereinafter referred to as "a second outer end 21") has a flange portion 22. The flange portion 22 is radial outwardly protruded from the second outer end 21. The flange portion 22 of the outer tube portion 12 is fixed to a flange portion 32 (see FIGS. 1 and 2) of the processing unit 3 by means of fixation members (e.g., a bolt and a nut) while being abutted thereto. It should be noted that the outer tube portion 12 includes the boss 17 (see FIG. 2) on the inner peripheral surface thereof for allowing a pressure sensor to pass therethrough and the boss 17 is opposed to the aforementioned cutout 16 of the inner tube portion 9.

Figure 7:
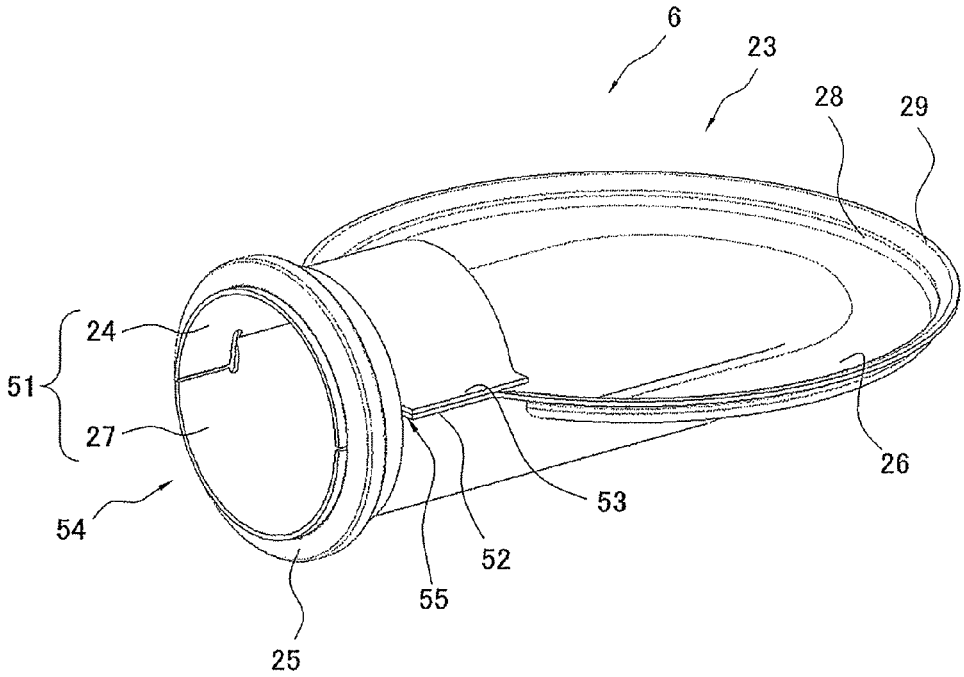
FIG. 7 is an oblique view of an inlet tube portion.

The inlet tube portion 6 is a member allowing exhaust gas to pass therethrough for transferring the exhaust gas to the first main body tube portion 5. The inlet tube portion 6 is connected to the exhaust path (not illustrated in the figure) of the internal combustion engine. As illustrated in FIG. 7, the inlet tube portion 6 includes a first component 23 (see FIG. 4), a second component 24 (second split half portion), and an annular member 25.

Figure 4:
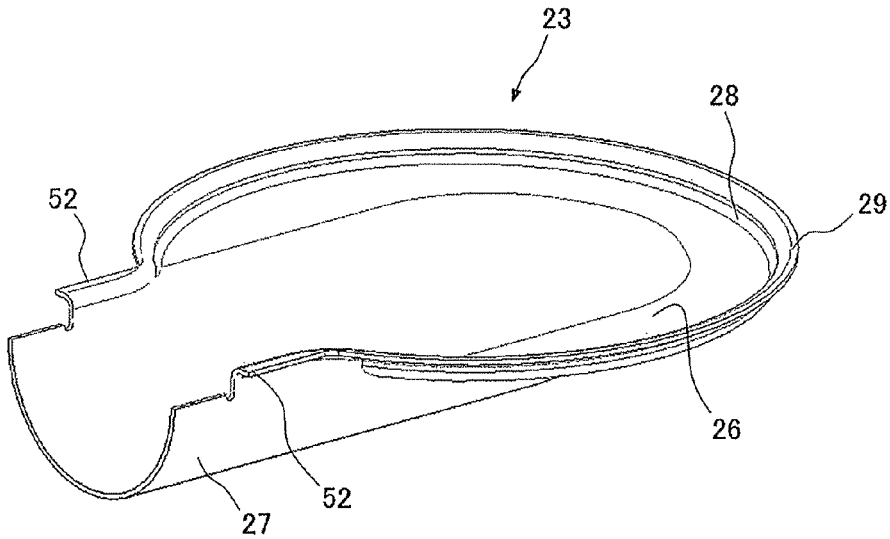
FIG. 4 is an oblique view of a first component.

As illustrated in FIG. 4, the first component 23 includes the plate portion 26 and a first split half portion 27.

The plate portion 26 has an outline identical to that of the first outer end 19 (see FIG. 12) of the outer tube portion 12. Further, the inner part of the plate portion 26, excluding the edge of the plate portion 26, is dented to be matched with the edge of the first inner end 13 of the inner tube portion 9. A stepped portion 28 is thus formed to be matched with the first inner end 13. The inner tube portion 9 is appropriately positioned with respect to the first component 23 when the first inner end 13 is abutted to the stepped portion 28 (see FIG. 8). A further inner part of the plate portion 26 continues to the first split half portion 27 while being outwardly bulged from the first split half portion 27. It should be noted that the plate portion 26 has the flange portion 29 in the edge thereof and the flange portion 29 has a roughly circular outline. Further, a cover member 20 is attached to a part of the outer tube portion 12 (i.e., a part disposed axially outside the plate portion 26) while covering the plate portion 26 (see FIGS. 1 and 2).

The first split half portion 27 is integrally molded with the plate portion 26. The first split half portion 27 is formed in a semi-cylindrical shape.

Figure 5:
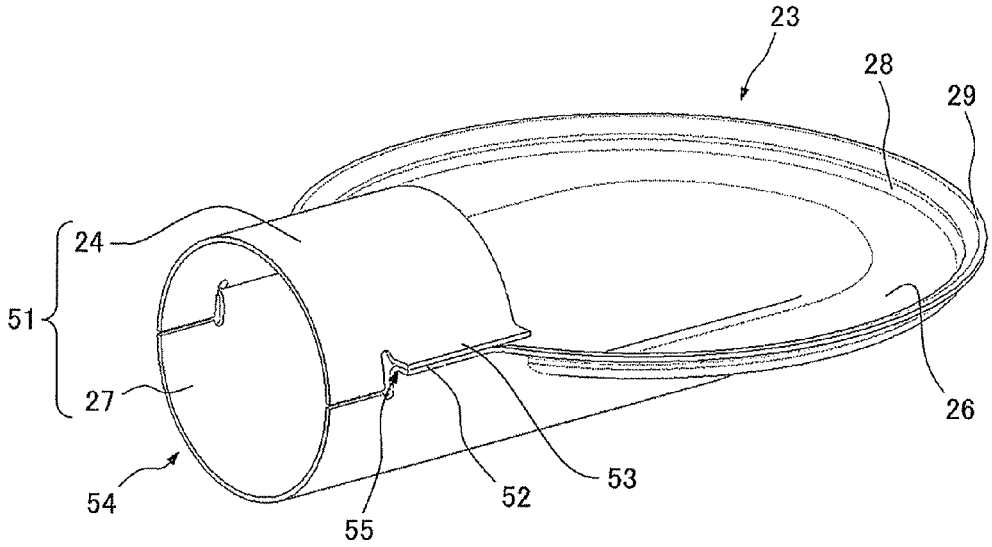
FIG. 5 is an oblique view of the first component that a second component is attached thereto.

As illustrated in FIGS. 2 and 5, the second component 24 is formed in a semi-circular shape. The second component 24 corresponds to a second split half portion configured to be joined to the first split half portion 27. The second component 24 and the first split half portion 27 form a tubular portion 51. The tubular portion 51 houses a first exhaust path R3 (see FIG. 2) in the inside thereof. The first exhaust path R3 communicates with the main body exhaust path R1. The tubular portion 51 is radial outwardly protruded from the outer peripheral surface of the first main body tube portion 5.

Figure 6:
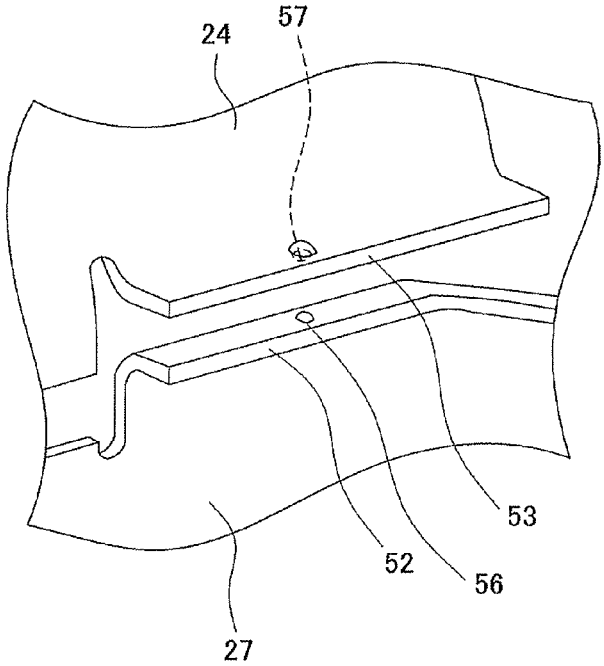
FIG. 6 is an enlarged view of flange portions of the first and second components.

The first split half portion 27 includes a flange portion 52 formed along the edge thereof, whereas the second component 24 includes a flange portion 53 formed along the edge thereof. As illustrated in FIG. 5, the flange portion 52 of the first split half portion 27 and the flange portion 53 of the second component 24 are abutted. The flange portions 52, 53 are disposed along the axial direction of the tubular portion 51 from one end of the tubular portion 51 (i.e., an end disposed closer to the first main body tube portion 5) to the other end of the tubular portion 51 (herein after referred to as "an inlet end 54"). A tip section 55 of the flange portions 52, 53 (i.e., a tip section closer to the inlet end 54) is positioned closer to the first main body tube portion 5 than the inlet end 54 is. Further, a part of the flange portion 52, which is closer to the first main body tube portion 5, continues to the flange portion 29 of the plate portion 26. Yet further, as illustrated in FIG. 6, the first split half portion 27 includes a convex portion 56 on a joint surface of the flange portion 52 thereof, whereas the second component 24 includes a concave portion 57 on a joint surface of the flange portion 53 thereof. The convex portion 56 and the concave portion 57 are engaged for appropriately positioning the first split half portion 27 and the second component 24. It should be noted in the present exemplary embodiment that the convex portion 56 is formed in the first split half portion 27 whereas the concave portion 57 is formed in the second component 24. Contrary to this, the concave portion 57 may be formed on the first split half portion whereas the convex portion 56 may be formed on the second component 24.

As illustrated in FIG. 7, the annular member 25 is attached onto the tubular portion 51 from the inlet end 54. The annular member 25 is fitted onto the tubular portion 51 under a condition that the annular member 25 is abutted to the tip section 55 of the flange portions 52, 53. Accordingly, the first split half portion 27 and the second component 24 are integrated.

Processing Unit 3 and Outlet Unit 4

The processing unit 3 is configured to purify exhaust gas transferred to the exhaust processing device 1. As illustrated in FIG. 2, the processing unit 3 includes the second main body tube portion 31 and a filter 33.

The second main body tube portion 31 is a tubular member including the flange portion 32 and a flange portion 34. The flange portions 32, 34 are radial outwardly protruded from the both ends of the second main body tube portion 31. The flange portion 32 closer to the inlet unit 2 is fixed to the flange portion 22 of the inlet unit 2 by means of fixation members (e.g., a bolt and a nut) while being abutted to the flange portion 22. The flange portion 34 closer to the outlet unit 4 is fixed to a flange portion 41 of the outlet unit 4 by means of fixation members (e.g., a bolt and a nut) while being abutted to the flange portion 41.

The filter 33 is a catalyst carrier configured to purify exhaust gas. The filter 33 is made of a ceramic. The filter 33 is formed in a cylindrical shape. The filter 33 is contained within the second main body tube portion 31 while the outer peripheral thereof is wrapped around by a heat insulator 35.

The outlet unit 4 is disposed downstream of the processing unit 3 in the exhaust gas flow. The outlet unit 4 allows exhaust gas purified by the processing unit 3 to pass therethrough for discharging the exhaust gas out of the exhaust processing device 1. The outlet unit 4 includes a third main body tube portion 42 and an outlet tube portion 43. The third main body tube portion 42 has a structure identical to that of the first main body tube portion 5 of the inlet unit 2, excluding that the third main body tube portion 42 is axially shorter than the first main body tube portion 5. Further, the outlet tube portion 43 has a structure identical to that of the inlet tube portion 6. Detailed explanations of the third main body tube portion 42 and the outlet tube portion 43 will be hereinafter omitted for the sake of brevity.

Manufacturing Steps of Exhaust Processing Device 1

Figure 3:
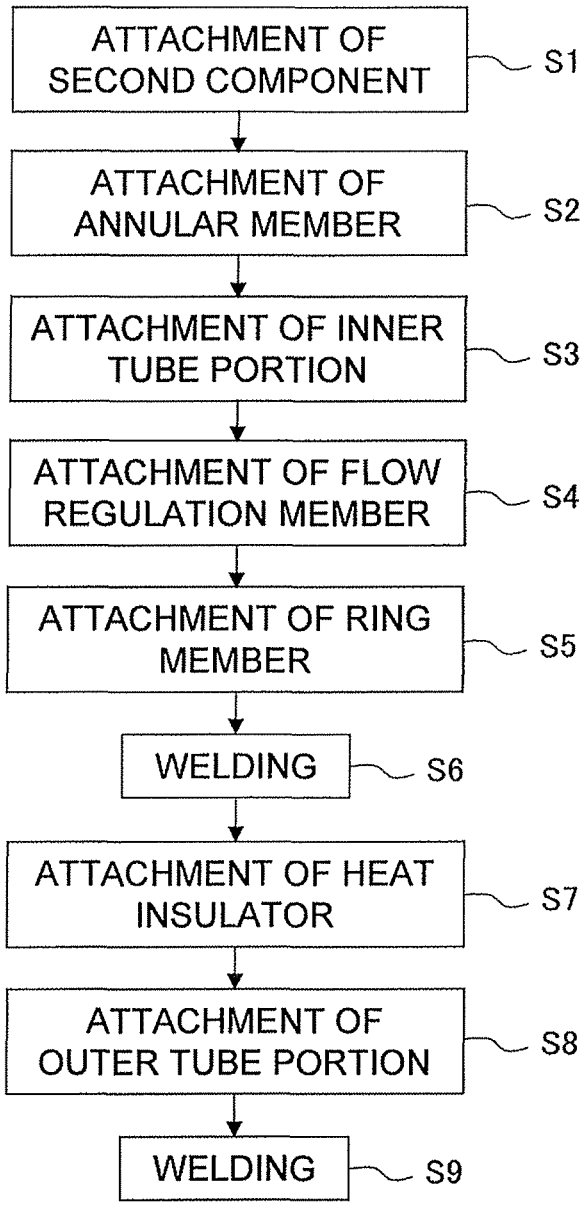
FIG. 3 is a flowchart for showing a series of manufacturing steps of an inlet unit.

Manufacturing steps of the exhaust processing device 1, among other things, manufacturing steps of the inlet unit 2 will be hereinafter explained with reference to FIG. 3.

In Step S1, attachment of the second component 24 is firstly executed. The second component 24 is herein attached to the first component 23 (see FIG. 4) as illustrated in FIG. 5. Specifically, the second component 24 is disposed on the first split half portion 27 under a condition that the flange portion 52 of the first split half portion 27 is abutted to the flange portion 53 of the second component 24. The convex portion 56 of the first split half portion 27 and the concave portion 57 of the second component 24 are herein engaged. Accordingly, the second component 24 is appropriately positioned with respect to the first component 23 (see FIG. 6).

Next, in Step S2, attachment of the annular member 25 is executed. As illustrated in FIG. 7, the annular member 25 is herein fitted onto the tubular portion 51. The annular member 25 is herein abutted to the tip section 55 of the flange portion 52 of the first split half portion 27 and the flange portion 53 of the second component 24. Accordingly, the annular member 25 is appropriately positioned with respect to the first component 23 and the second component 24.

Next, in Step S3, attachment of the inner tube portion 9 is executed. As illustrated in FIG. 8, the inner tube portion 9 is herein disposed on the plate portion 26. The first inner end 13 of the inner tube portion 9 is herein abutted to the stepped portion 28 (see FIG. 7) of the plate portion 26. Accordingly, the inner tube portion 9 is appropriately positioned with respect to the plate portion 26, i.e., the inlet tube portion 6.

Figure 9:
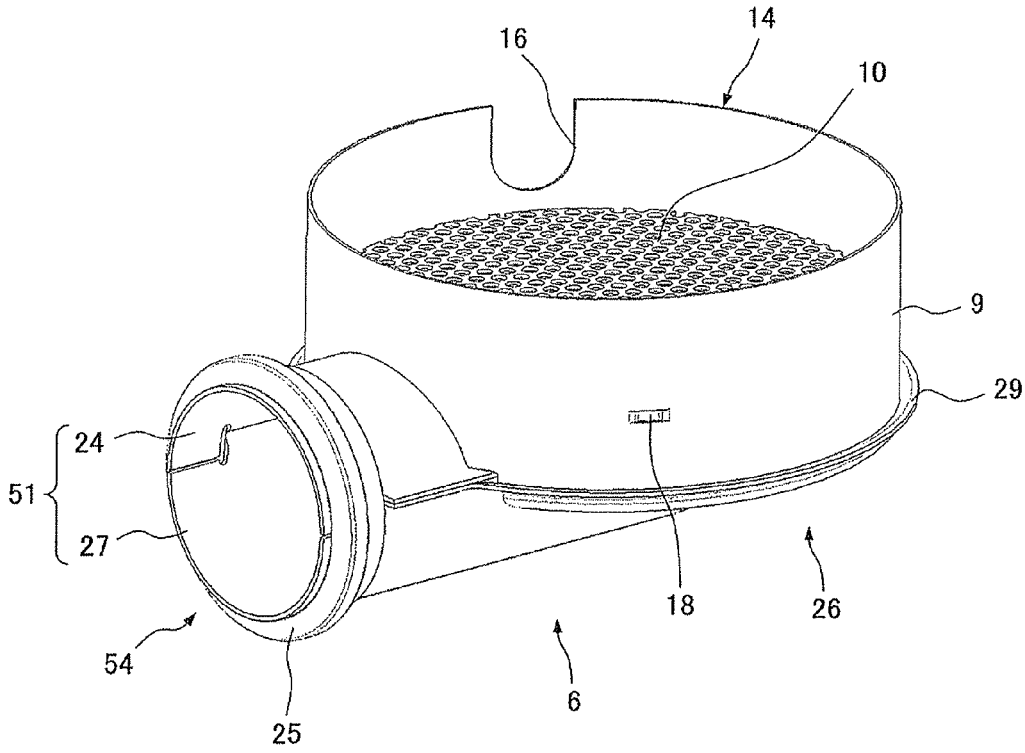
FIG. 9 is an oblique view of the inner tube portion that a flow regulation member is attached thereto.

Next, in Step S4, attachment of the flow regulation member 10 is executed. As illustrated in FIG. 9, the flow regulation member 10 is herein inserted into the inner tube portion 9. The flow regulation member 10 is herein hooked by the protrusions 18 disposed on the inner peripheral surface of the inner tube portion 9. Accordingly, the flow regulation member 10 is appropriately positioned with respect to the inner tube portion 9.

Next, in Step S5, attachment of the ring member 15 is executed. As illustrated in FIG. 10, the ring member 15 is herein attached to the second inner end 14 of the inner tube portion 9. The ring member 15 is herein temporarily fixed to the inner tube portion 9 by means of a jig (e.g., a clamper).

Next, in Step S6, welding is executed. The aforementioned components assembled in Steps S1 to S5 are joined by means of welding while the first component 23 is fixed by means of a jig. Specifically, continuous welding is executed for: a joint section between the first split half portion 27 and the second component 24; and a joint section between the annular member 25 and the tubular portion 51. On the other hand, intermittent welding is executed for: a joint section between the plate portion 26 and the first inner end 13 of the inner tube portion 9; a joint section between the end of the second component 24, which is closer to the first main body tube portion 5, and the outer peripheral surface of the inner tube portion 9; a joint section between the flow regulation member 10 and the inner peripheral surface of the inner tube portion 9; and a joint section between the ring member 15 and the second inner end 14 of the inner tube portion 9.

Next, in Step S7, attachment of the heat insulator 11 is executed. As illustrated in FIG. 11, the heat insulator 11 in a mat shape is herein wrapped around the outer peripheral surface of the inner tube portion 9.

Next, in Step S8, attachment of the outer tube portion 12 is executed. As illustrated in FIG. 12, the inner tube portion 9 is herein press-inserted into the outer tube portion 12 while the outer tube portion 12 covers the inner tube portion 9 that the heat insulator 11 is wrapped therearound.

Next, in Step S9, welding is executed. Continuous welding is herein executed for a joint section between the first outer end 19 of the outer tube portion 12 and the inlet tube portion 6.

It should be noted that the manufacturing steps of the outlet unit 4 is identical to those of the inlet unit 2.

According to the exhaust processing device 1, the first component 23 of the inlet tube portion 6 functions as a member configured to close the opening of the first main body tube portion 5. Therefore, the exhaust processing device 1 can be formed by a small number of components. Accordingly, the exhaust processing device 1 can be easily assembled.

Further, in the manufacturing steps of the inlet unit 2, members are sequentially disposed and appropriately positioned based on the first component 23. Yet further, the members can be appropriately positioned easily without using a separately prepared jig. For example, in the aforementioned manufacturing steps of the exhaust processing device 1, members can be assembled without using a jig in Steps S1 to S4, S7, and S8, excluding attachment of the ring member 15 in Step S5. Further, welding is not required for temporal attachment of the members. Therefore, the members can be easily assembled.

Further, most of the welding sections are outwardly faced in welding. It is thereby possible to avoid contacts between members and a welding torch. This allows a welding robot to easily execute automatic welding. For example, the welding robot can execute automatic welding with respect to the first split half portion 27 and the second component 24 from the outside under the condition that the first split half portion 27 and the second component 24 are coupled to each other as described above. Further, the welding section between the first split half portion 27 and the second component 24 has a linear welding line. Therefore, welding can be easily done for the first split half portion 27 and the second component 24. Consequently, the inlet tube portion 6 can be easily manufactured.

Further, the inlet tube portion 6 and the inner tube portion 9 are manufactured as a sub-unit. Accordingly, the inlet portion 6 and the inner tube portion 9 can be structured under a condition that the welding section thereof is faced to the outside. Yet further, when the inlet tube portion 6 and the inner tube portion 9 are coupled in combination, these components are more compactly formed than the entire inlet unit 2. Therefore, it is possible to easily avoid contacts between a welding torch and the members in welding of the inlet tube portion 6 and the inner tube portion 9. A robot is thereby allowed to execute automatic welding. Consequently, manufacturing can be easily done.

The exhaust processing device 1 can be easily manufactured by the aforementioned manufacturing steps.

Other Exemplary Embodiments

In the aforementioned exemplary embodiment, the tubular portion 51 is formed straight along the axial direction. However, the shape of the tubular portion 51 is not limited to this. For example, the tubular portion 51 may be transversely expanded towards the main body tube portion (i.e., a maximum width of the tubular portion becomes larger as it gets towards the main body tube portion). In this case, smooth flow of exhaust gas can be achieved from the inlet tube portion 6 to the first main body tube portion 5.

The above described embodiments have an advantageous effect of easily manufacturing an exhaust processing device. The present invention is therefore useful for an exhaust processing device and a manufacturing method thereof.

The invention claimed is:

1. An exhaust processing device comprising:

a main body tube portion, a closing tube portion, and an annular member, the main body tube portion including an opening in an axial end thereof, and the main body tube portion housing a main body exhaust path in an inside thereof to allow an exhaust gas to pass therethrough; the closing tube portion including a plate portion covering the opening of the axial end of the main body tube portion, and a tubular portion radially outwardly protruding from an outer peripheral surface of the main body tube portion, the tubular portion being integrated with the plate portion, the tubular portion housing an exhaust path in an inside thereof, the exhaust path communicating with the main body exhaust path, and the tubular portion including a first split half portion integrally molded with the plate portion and having a first joint surface, and a second split half portion having a second joint surface and joined to the first split half portion such that the second joint surface engages with the first joint surface of the first split half portion, one of the first joint surface and the second joint surface including one of a convex portion and a concave portion, and the other of the first joint surface and the second joint surface including the other of the convex portion and the concave portion, the convex portion and the concave portion being configured to be engaged for appropriately positioning the first and second split half portions; and the annular member being fitted onto the tubular portion with the annular member abutting an end of a flange portion disposed along an edge of the first split half portion and an end of a flange portion disposed along an edge of the second split half portion for integrating the first split half portion and the second split half portion.

2. The exhaust processing device according to claim 1, further comprising a meshed flow regulation member joined to an inner peripheral surface of the main body tube portion with the flow regulation member being hooked on a plurality of protrusions radially inwardly protruding from the inner peripheral surface of the main body tube portion and circumferentially aligned on the inner peripheral surface of the main body tube portion.

3. The exhaust processing device according to claim 1, wherein the plate portion includes a stepped portion dented to be matched with an edge of the axial end of the main body tube portion, and the axial end of the main body tube portion is appropriately positioned by the stepped portion abutted thereto.

4. The exhaust processing device according to claim 1, wherein the main body tube portion includes an inner tube portion joined to the plate portion, a heat insulator covering an outer peripheral surface of the inner tube portion, and an outer tube portion covering an outer periphery of the heat insulator, the outer tube portion being axially longer than the inner tube portion.

5. The exhaust processing device according to claim 1, wherein the tubular portion has a maximum width that becomes larger towards the main body tube portion.

6. A method of manufacturing an exhaust processing device, the exhaust processing device including: a main body tube portion having an opening in an axial end thereof, the main body tube portion housing a main body exhaust path in an inside thereof, the main body exhaust path allowing an exhaust gas to pass therethrough; a tubular portion radially inwardly protruding from an outer peripheral surface of the main body tube portion, the tubular portion housing an exhaust path in an inside thereof, the exhaust path communicating with the main body exhaust path; and an annular member configured to fit onto the tubular portion, the method comprising:

assembling a closing tube portion by attaching a second split half portion to a first component, the first component including a plate portion and a first split half portion integrally molded with the plate portion, the first split half portion and the second split half portion forming the tubular portion;

attaching the annular member onto the tubular portion from an inlet end of the tubular portion such that the annular member abuts against a first flange portion of the first split half portion and a second flange portion of the second split half portion; and attaching the closing tube portion to the main body tube portion so that the plate portion covers the opening of the axial end of the main body tube portion.

* * * * *